United States Patent [19]

Berger et al.

[11] Patent Number: 5,060,821

[45] Date of Patent: Oct. 29, 1991

[54] LABEL DISPENSER FOR POSTAGE METER MACHINE

[75] Inventors: Erwin Berger, Thörishaus; Christian Moy, Grossaffoltern, both of Switzerland

[73] Assignee: Ascom Hasler AG, Bern, Switzerland

[21] Appl. No.: 361,979

[22] Filed: Jun. 6, 1989

[30] Foreign Application Priority Data

Jun. 6, 1988 [CH] Switzerland ..... 02 157/88

[51] Int. Cl.[5] ..... B65H 3/06

[52] U.S. Cl. ..... 221/190; 221/209; 221/231; 221/259

[58] Field of Search ..... 221/186, 190, 187, 209, 221/228, 231, 237, 236, 259, 261, 277; 271/10, 113, 164

[56] References Cited

U.S. PATENT DOCUMENTS 2,288,870 7/1942 Weber et al. ..... 221/187

4,492,315 1/1985 Hooper ..... 221/231 X

*Primary Examiner*—David H. Bollinger

*Attorney, Agent, or Firm*—Horst M. Kasper

[57] ABSTRACT

A label dispenser (10) includes a storage container (13) for labels (11). A withdrawal roller (15) is in contact with the labels (11) and is supported together with a gear-wheel pinion (17) and a free-wheeling bearing (19) at the storage container (13). The pinion (17) is engaged with a fixed-position gear rack (23). As soon as the finger pressure actuates the server plate (29), the storage container (13) is pressed downwardly, the gear-wheel pinion (17) rotates the withdrawal roller (15) such that the outermost label is pushed out downwardly out of the storage container (13). The outermost label is then gripped by a transport roller pair and can be transported off. As soon as the finger pressure is released, a helical spring (37) slides the storage container (13) back into the starting position. In this case, a hollow cylinder (33), together with an air valve (39) furnishes a braking of the speed, while the free-wheeling bearing (19) runs freely.

9 Claims, 3 Drawing Sheets

LABEL DISPENSER FOR POSTAGE METER MACHINE

BACKGROUND OF THE INVENTION

1. Field of the Invention

The invention relates to a label dispenser for a postage meter machine including a storage container, a withdrawal roller, and a pretensioned spring, which maintains the dispenser in its rest position.

2. Brief Description of the Background of the Invention Including Prior Art

A postage meter machine is known from R. Grüunig, "Die Frankiermaschine Hasler Mailmaster," (The Postage Meter Machine Hasler Mailmaster), Hasler Mitteilungen 37 (1978) 1, 1–7, which postage meter machine is equipped with a strip dispenser. This strip dispenser delivers by manual lever pressure in each case a self-adhesive label to the franking device of the machine, which furnishes the label with a post-office-valid value impression and, possibly, with a date as well as with an advertising stamp. The label serves then for providing postage to a piece of mail, for example, a small parcel. An English description of the Hasler Mailmaster F 204 Franking Machine is given in Hasler Review, Volume 11, No. 1, The strip dispenser can comprise about one hundred labels in its removable container. The lever, to be operated manually, is furnished with a gear rack. The gear rack engages a gear wheel. This gear wheel, together with a pull-off roller, is disposed on an axis, where the pull-off roller is supported via a free-wheeling bearing.

The pull-off roller is rotated upon actuation of the lever via the gear rack, the gear wheel, and the free-wheeling bearing. The label resting at the pull-off roller is thereby drawn out so far downwardly until it is gripped by the transport roller of the franking machine and can be transported off. During the transporting off, the free-wheeling bearing releases the motion of the pull-off roller such that the label can move freely. A restoring spring returns the lever into its starting position.

The recited strip dispenser is employed today worldwide in franking machines of the type Hasler Mailmaster, and dispenses labels, which can be adapted in size and design to comply with the different post office regulations and to suit different requirements. The strip dispenser is however associated with the disadvantage, that it is not sufficiently suitable for shorter labels, i.e. that these cannot be withdrawn from the container with adequate reliability.

SUMMARY OF THE INVENTION

1. Purposes of the Invention

It is an object of the invention to furnish an improved label dispenser for postage meter machines, which can reliably individualize labels of the prevailing types, including labels that are shorter than the ones used up to now, and which can feed these labels to the transport rollers of the postage meter machine.

These and other objects and advantages of the present invention will become evident from the description which follows.

2. Brief Description of the Invention

The present invention provides for a label dispenser for a postage meter machine. A storage container for labels can be shifted in a linear direction relative to a counter piece against the force of a spring. A shaft is supported at the storage container. A gear-wheel pinion and a free-wheeling bearing are disposed together with a withdrawal roller on the shaft. The labels contained in the storage container are pressed by a spring-loaded clamp against the withdrawal roller. A gear rack is disposed at the counter piece and engages a pinion. A pretensioned spring maintains the label dispenser in its rest position.

A return-motion unit can provide a braking effect by means of the pretensioned spring while returning the label dispenser to its rest position.

The brake means can be comprised of a cylindrical frame-support part, a cylindrical runner part, and a valve. The diameter of the cylindrical runner part can be adapted to the cylindrical frame-support part. The frame-support part and the runner part are concentrically slidable into each other. The runner part can be solidly connected with the storage container, and the frame support part can be solidly connected with the counter piece. The valve can block the entry blocking the entry of air into the interior of the frame-support part and of the runner part.

The dispenser can form a self-contained component group which can be inserted as a unit into a postage meter machine.

The novel features which are considered as characteristic for the invention are set forth in the appended claims. The invention itself, however, both as to its construction and its method of operation, together with additional objects and advantages thereof, will be best, understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
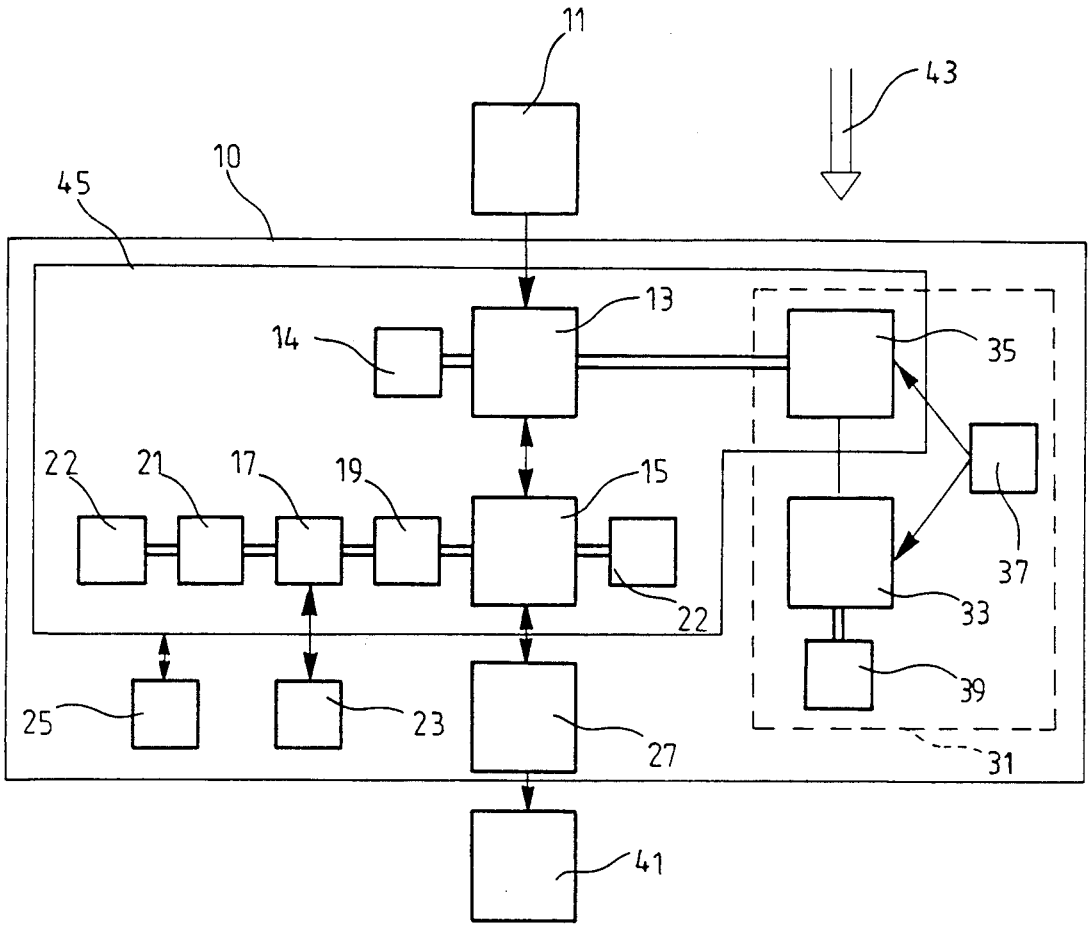
FIG. 1 is a schematic block diagram of the label dispenser.

In accordance with the present invention, there is provided a label dispenser 10 for a postage meter machine, which dispenser 10 comprises a storage container 13 for labels 11. A withdrawal roller 15 is disposed on a shaft 21 together with a gear-wheel pinion 17 and a free-wheeling bearing 19. A spring-loaded clamp 14 presses the labels 11 contained in a storage container 13 against the withdrawal roller 15. A gear rack 23 engages the pinion 17. A pretensioned spring 37 maintains the dispenser 10 in its rest position. The shaft 21 is supported at the storage container 13. The gear rack 23 is disposed at a counter piece. The storage container 13 can be shifted in a linear direction relative to the counter piece against the force of the spring 37.

A brake can be provided to brake the restoring of the storage container 13 into the rest position by the force of the spring 37. The brake can comprise a cylindrical frame-support part 33, an also cylindrical runner part 35, adapted in its diameter to the cylindrical frame-support part 33, and a valve 39. The frame-support part 33 and the runner part 35 can be concentrically slidable into each other. The runner part 35 can be solidly connected with the storage container 13. The frame-support part 33 can be solidly connected with the counter piece. The valve 39 can block the entry of air into the interior of the frame-support part 33 and of the runner part 35. The valve 39 can thus block the air flow into the return motionunit. However, air is flowing elsewhere. In particular, air can escape between the walls of the frame support part 33 and of the runner part 35. This possibility of escape for the air assures that no vacuum is formed, but instead a slow and damped movement is possible.

FIG. 1 provides a schematic view of the label dispenser 10 for postage meter machines similar to a block circuit diagram. The dispenser 10 forms a self-contained component group, which can be inserted as a unit into the postage meter machine. This component unit subdivides itself into several sub-groups, which belong to each other based on various different criteria. A predominantly mechanical association is indicated by double lines, and a more functional association is indicated by arrows.

The label dispenser 10 includes first a storage container 13, into which the strip-shaped, self-adhesive labels 11 can be inserted as a bundle. The labels are maintained in their position by the pressure of a spring-loaded clamp 14. The labels rest with their print side on a withdrawal roller 15 This withdrawal roller 15 is disposed on an axle or, respectively, a shaft 21 together with a gear-wheel pinion 17 and a free-wheeling bearing 19. The axle or, respectively, the shaft 21 is supported by two bearings 22 at the storage container 13. Finally, a runner part 35 is mechanically connected to the storage container 13, which runner part 35, based on its function, is associated to a reversing return-motion unit 31.

The units 13, 14, 15, 17, 19, 21, 22, 35 described up to now, form a slidable sub-group 45, which can be slid, by a manual actuation, in the direction of the double arrow 43 relative to the other units. These other, immovable units comprise in particular a gear rack 23, which engages the pinion 17. Furthermore, they include a guide 25, disposed in parallel to the gear rack 23, which guide 25 linearly guides the slidable sub-group 45.

Finally, a frame support part 33 belongs to the immovable units, and an air valve 39 is attached to the frame support part. These two units form together with the runner part 35 and a helical spring 37 the recited return-motion unit 31. The return-motion unit 31 is formed such that the pretensioned spring 37 continuously presses apart the runner part 35 and the frame-support part 33 against the direction of the double arrow 43 up to a stop, not illustrated. The runner part 35 and the frame-support part 33 engage each other such that upon motion the air friction becomes important. The valve 39 decreases this friction in case of a manual pressing together of the return-motion unit 31. During pressing apart of the return-motion unit 31 by the spring 37, the valve 39 blocks in such a way that a braking effect is generated by the air friction.

Figure 2:
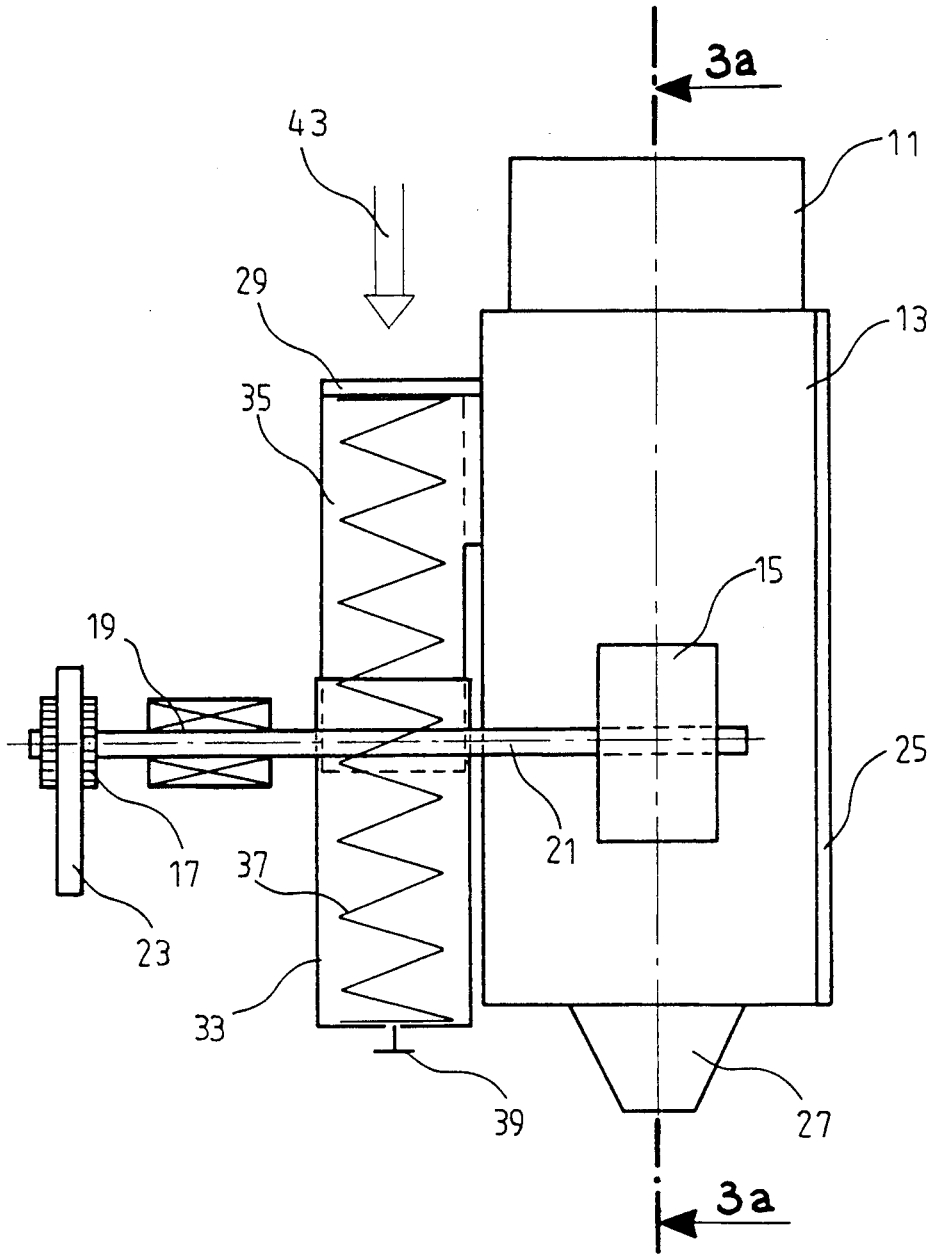
FIG. 2 is a schematic front view of the label dispenser.

FIG. 2 illustrates the label dispenser 10 in a schematic front view. The storage container 13 and the runner part 35 are formed next to each other as units closely connected to each other. The storage container 13 exhibits a cubic construction for the reception of a stack of labels 11. The runner part 35 forms a downwardly open, hollow cylinder, where the upper front face is formed as a server plate 29, which can be pressed downward by the pressure of a finger in the direction of the double arrow 43.

The frame-support part 33 cooperates with the runner part 35. The frame-support part 33 also forms a hollow cylinder, which is adapted in its diameter to the diameter of the runner part such that these parts 33, 35 engage each other with low friction but with substantial sealing for air-separation. The helical spring 37 is disposed under pretensioning in the interior of the two parts 33, 35. The valve 39 is disposed in the floor of the frame-support part 33. The valve 39 opens during compression of the parts 33, 35 and closes during the moving apart of the parts 33, 35.

The guide 25 guides, for example, by way of a groove, the side wall of the storage container 13. The withdrawal roller 15 contacts the stack of labels 11 at the front side of the storage container by way of an opening of the container. The withdrawal roller 15 is rigidly connected to the shaft 21, where the pinion 17 is supported freely rotatable in one rotation direction via the free-wheeling bearing 19. The pinion 17 is engaged with the gear rack 23. Finally, the label guide 27 is disposed at the lower end of the storage container 13 or, respectively, at the discharge port of the storage container.

Figure 3A:
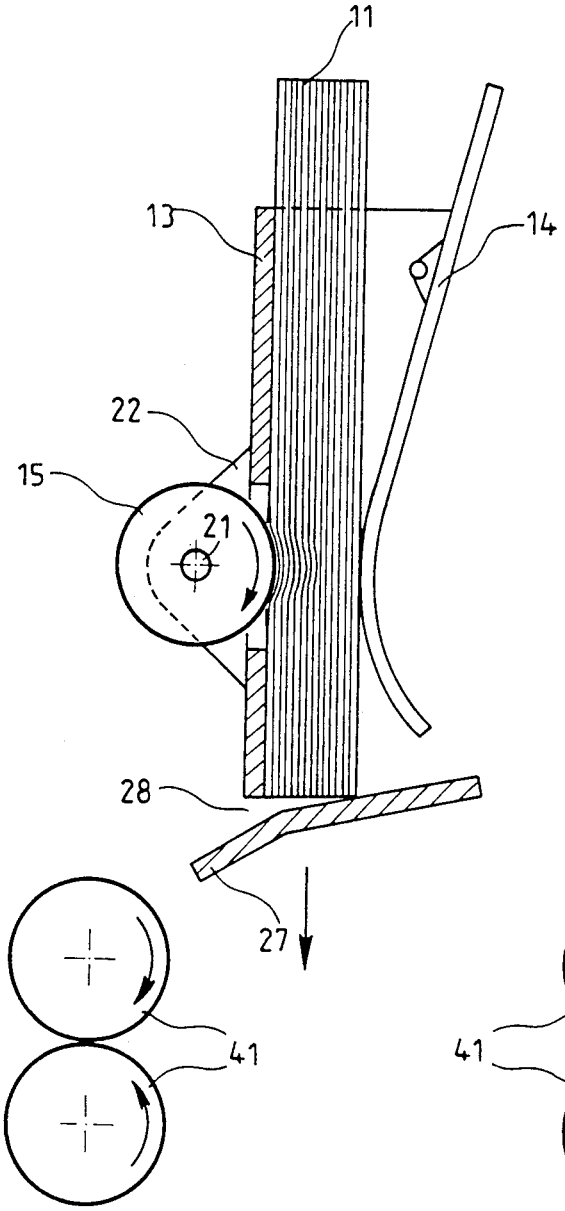
FIG. 3*a* is a schematic side view of the label dispenser in a position prior to dispensing.
Figure 3B:
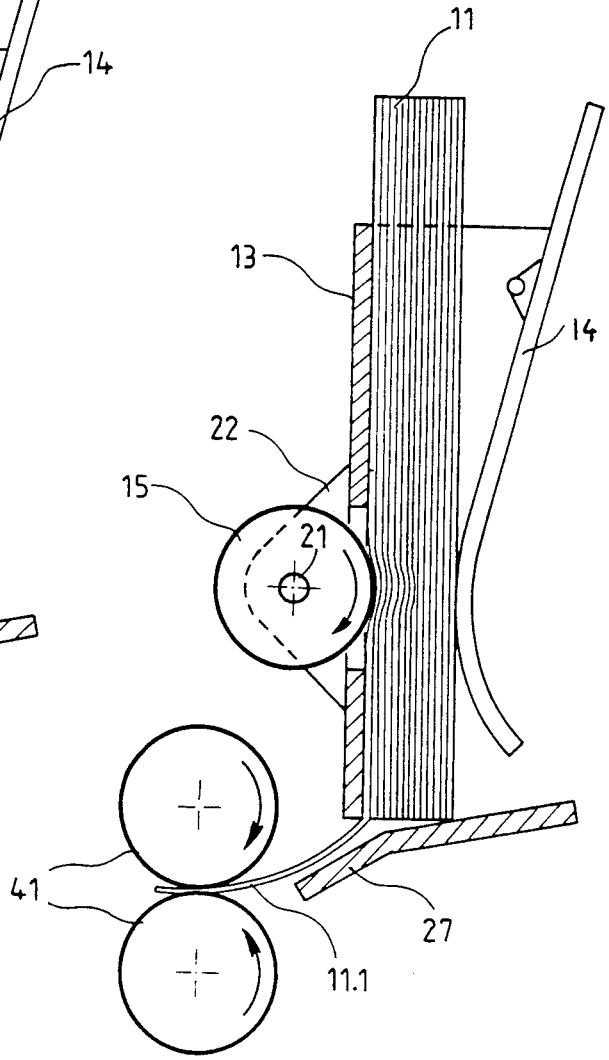
FIG. 3*b* is a schematic side view of the label dispenser during the dispensing motion of label.

The label dispenser 10 is illustrated in a schematic side view in FIGS. 3*a* and 3*b*, sectioned approximately along section line A—A of FIG. 2. FIG. 3*a* illustrates the label dispenser 10 in its rest position, and in FIG. 3*b* an operating position is shown. The stack of labels 11 is pressed with the spring-loaded clamp 14 against the withdrawal roller 15 in the sectioned storage container 13 and is thus retained in position. The withdrawal roller 15 is disposed on the shaft 21, and the shaft 21 is supported in the bearing 22, covered in the figure, which bearing 22 in turn is attached at the storage container. The discharge port 28 of the container 13 and the label guide 27 are disposed at the lower front end of the storage container 13. The withdrawal roller pair 41 of the postage meter machine is disposed on the side below the label dispenser 10.

The apparatus operates as follows: When the server plate 29 is manually pressed downward against the pressure of the spring 37, then the storage container 13 is thereby moved in a downward direction along its guide 25. Further, the shaft 21 moves downwardly. Based on the engagement of the pinion 17 in the gear rack 23, there results a rotation, which rotation is transferred via the blocking free-wheeling bearing 19 to the withdrawal roller 15. The withdrawal roller pulls now, based on the different adhesion frictions between the withdrawal roller 15 and the outermost label or, respectively, between the labels themselves, the recited outermost label 11.1 in downward direction, where it is fed via the guide 27 to the withdrawal roller pair 41.

The linear motion of the storage container 13 or, respectively, of the stack of labels 11 is superposed with the pulling-off rotary motion of the withdrawal roller 15 during the process described. The label, to be respectively individualized, passes thereby with the storage container 13 and the guide 27 close to the withdrawal roller pair 41 such that the label has to be pushed out of the storage container 13 less far as compared to a conventional label dispenser by the corresponding amount.

As soon as the individualized label 11.1 is gripped by the withdrawal roller pair 41, it is completely pulled out of the storage container 13 by the withdrawal roller pair 41. The withdrawal roller 15 freely rotates in this case because of the free-wheeling bearing 19.

The helical spring 37 presses the label dispenser 10 back into its rest position as soon as the finger pressure, resp. the manual pressure on the server place 29 is released. The withdrawal roller 15 rotates freely also during the reverse motion induced thereby. The return-motion unit 31 takes care in this case that the reverse motion is performed under braking. The frame support part 33 and the runner parts 35, disposed inside of each other, as well as the valve 39, form for this purpose the recited brake, which does not interfere with the flowing of the air out of the cylinder space of the parts 33, 35, which however hinders the reentry of the air during a reverse process.

The described label dispenser 10 is simple and operates according to its purpose. The discharge port 28 of the dispenser 10 is brought close to the withdrawal roller pair 41 based on the linear motion of the dispenser 10 such that the length of the individual labels can thereby be quite small. The arrangement can be adapted to various spatial dimensions based on a suitable selection of the diameter of the withdrawal roller 15 and of the pinion 17. The label dispenser is constructed such that it can be composed in substantial parts from injection-molded plastic parts. This allows to keep the production costs relatively low.

As variants of the recited preferred label dispenser 10, there are recited:

The pinion 17 and the withdrawal roller 15 are rotatably disposed on a rigid shaft 21.

The free-wheeling bearing 19 acts primarily with the withdrawal roller 15 instead of with the pinion 17.

The overall construction can be reversed, like a mirror image of the construction illustrated.

The runner part 35 can have a larger diameter as compared to the frame-support part 33, or vice versa.

It will be understood that each of the elements described above, or two or more together, may also find a useful application in other types of label dispensers differing from the types described above.

While the invention has been illustrated and described as embodied in the context of a label dispenser for a postage meter machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A label dispenser for a postage meter machine comprising a counter piece;

a storage container for labels movably mounted on the counter pieces wherein the storage container can be shifted in a linear direction relative to the counter piece against the force of a pretensioned spring between a rest position and a dispensing position;

an outlet provided in said storage container;

a spring-loaded clamp within said storage container wherein the labels contained in the storage container are pressed by the spring loaded clamp against the outlet;

a shaft supported on the storage container;

a withdrawal roller mounted on an end of said shaft so as to be disposed adjacent the outlet of said storage container in engagement with the labels pressed against the outlet;

a free-wheeling bearing mounted adjacent the end of the shaft opposite the end having said withdrawal roller;

a gear-wheel pinion mounted on said shaft to be freely rotatable in one direction by the free-wheeling bearing;

a gear rack, mounted on the counter piece and engaging the gear-wheel pinion whereby linear movement of the storage container from its rest position to its dispensing position to cause rotation of the gear-wheel pinion and thereby the withdrawal roller to advance a label through the outlet and the pretensioned spring returns the storage container to its rest position such that the gear-wheel pinion is freely rotatable in said one direction so the withdrawal roller does not dispense a label.

2. The label dispenser according to claim 1, further comprising a braking unit, providing a braking effect while shifting back said storage container by the force of said pretensioned spring to said rest position of said storage container.

3. The label dispenser according to claim 2, the said braking unit comprising a cylindrical frame-support part connected with said counter piece;

a cylindrical runner part connected with said storage container;

a valve connected with said frame-support part, wherein the outer diameter of said cylindrical runner part and the inner diameter of said cylindrical frame support are adapted to one another in such a way that said cylindrical runner is concentrically slidable within said cylindrical part frame-support part, and wherein said valve opens to allow escape of air from said cylindrical frame support part and cylindrical runner support part while said storage container is shifted in said linear direction and closes to reduce flow of air into said cylindrical frame support part and cylindrical runner support part while said storage container is shifted back by the force of said pretensioned spring.

4. The label dispenser according to claim 2, wherein said dispenser forms a self-contained component group which can be inserted as a unit into said postage meter machine.

5. Label dispenser (10) for a postage meter machine, comprising a counter piece;

a storage container (13) for labels (11) movably mounted on the counterpiece, wherein the storage container (13) can be shifted in a linear direction relative to the counter piece against the force of a pretensioned spring (37) between a rest position and a dispensing position;

an outlet provided in said storage container (13); a spring-loaded clamp (14), which clamp presses the labels (11) contained in the storage container (13) against the outlet;

a shaft (21) supported on the storage container (13);

a withdrawal roller (15) mounted on an end of said shaft (21) so as to be disposed adjacent to said outlet of said storage container (13) in engagement with the labels (11) pressed against the outlet;

a free-wheeling bearing (19) mounted adjacent the end of the shaft (21) opposite the end having said withdrawal roller (15);

a gear-wheel pinion (17) mounted on said shaft (21) to be freely rotatable in one direction by the free-wheeling bearing (19);

a gear rack (23) mounted on the counter piece and engaging the gear-wheel pinion (17); a pretensioned spring (37), which maintains the dispenser (10) in its rest position;

whereby linear movement of the storage container (13) from its rest position to its dispensing position rotates the gear-wheel pinion (17) and thereby rotates the withdrawal roller (15) for advancing a label (11) through the outlet, and wherein the pretensioned spring (37) returns the storage container (13) to its rest position such that the gear-wheel pinion (17) is freely rotatable in said one direction and such that the withdrawal roller (15) does not dispense a label (11).

6. Label dispenser (10) according to claim 5, wherein a brake is provided, which brakes the restoring of the storage container (13) into the rest position by the force of the spring (37).

7. Label dispenser (10) according to claim 6, wherein the brake comprises a cylindrical frame-support part (33), a cylindrical runner part (35), and a valve (39);

wherein the cylindrical frame-support part (33) and the cylindrical runner part (35) are concentrically slidable into each other;

wherein the cylindrical runner part (35) is solidly connected with the storage container (13), and the cylindrical frame-support part (33) is solidly connected with the counter piece; and wherein the valve (39), attached at the cylindrical frame support part (33), partly blocks the entry of air into the interior of the cylindrical frame-support part (33) and of the cylindrical runner part (35).

8. Label dispenser according to claim 7 wherein air can escape between the walls of the cylindrical frame support part (33) and of the cylindrical runner part (35) for obtaining a slow and damped movement.

9. The label dispenser according to claim 5 comprising a valve partly blocking the air flow into a return motion unit for returning said storage container to its rest position where said return motion unit comprises a cylindrical frame support part and a cylindrical runner part slidable within said cylindrical frame support part and wherein air can escape between walls of the cylindrical frame support part and of the cylindrical runner part for obtaining a slow and damped movement.

* * * * *